United States Patent [19]

Yaoita

[11] Patent Number: 4,905,290

[45] Date of Patent: Feb. 27, 1990

[54] HOWLING PROTECTIVE APPARATUS

[75] Inventor: Akira Yaoita, Tokyo, Japan

[73] Assignee: Viva Co., Ltd., Noda, Japan

[21] Appl. No.: 378,674

[22] Filed: Jul. 12, 1989

[30] Foreign Application Priority Data

Jul. 12, 1988 [JP] Japan ..... 63-309367

[51] Int. Cl.[4] ..... H04R 27/00

[52] U.S. Cl. ..... 381/83; 381/93

[58] Field of Search ..... 381/83, 93, 97

[56] References Cited

U.S. PATENT DOCUMENTS 4,079,199 3/1978 Patronis, Jr. ..... 381/83
4,449,237 5/1984 Stepp et al. ..... 381/83
4,747,144 5/1988 Admiraal et al. ..... 381/83

*Primary Examiner*—Forester W. Isen
*Attorney, Agent, or Firm*—Armstrong, Nikaido, Marmelstein, Kubovcik & Murray

[57] ABSTRACT

A howling protective apparatus comprising a phase fluctuation control means, a wave peak comparison means and a timer circuit, wherein said phase fluctuation circuit is controlled by an output from said timer circuit; a howling protective apparatus comprising a gain control means, a wave peak comparison means and a changing means for varying a coefficient of integration; a howling protective apparatus comprising a phase fluctuation circuit, a variable gain circuit and a wave peak comparison circuit, wherein said phase fluctuation circuit and the variable gain circuit are controlled by an output from said wave peak comparison circuit.

3 Claims, 6 Drawing Sheets

HOWLING PROTECTIVE APPARATUS

BACKGROUND OF THE INVENTION

1. Field of the Invention

The present invention relates to a howling protective apparatus for a sound device comprising a microphone, an amplifier and a speaker.

2. Prior art

With a speaker device in which a microphone and a speaker are located in the same sound field, direct sound entered in the microphone is amplified by an amplifier and then sounded into space through the speaker Indirect sound, outputted from the speaker, again enters into the microphone. At that time, if the amplification degree of the speaker device is large in excess or any resonance occurs to a particular frequency because of the effect from the transmission frequency characteristics of the sound field, the secondary input affected by the indirect sound output from the speaker becomes higher in level than the primary input entered in the microphone, and inputted into the microphone. Since these operations are repeated sequentially, the sound in the particular frequency is amplified and enhanced until the sound signal saturates in any component medium in the loop of the sound system. The phenomenon is called howling.

In order for preventing howling, various methods for suppressing the feedback quantity of speaker sound to the microphone have been proposed conventionally.

For example, (1) a microphone with a directivity to a sound source is used and located as near the sound source as possible, thereby increasing the ratio of a direct sound to an indirect sound. (2) A speaker of a sharp directivity is used to suppress positive feedback of an indirect sound. (3) Transmission frequency characteristics are limited near peak values, using an equalizer. (4) Phase is shifted. (5) Frequency fluctuation is given. (6) A switch is changed over to shut out speaker sound to enter the microphone.

Even when these methods are introduced, said means (1) and (2) are not applicable to a moving sound source. In (3), there are many howling frequencies besides near peak values. In (4), the effect of shifted phase is not even but depends on frequency, sound pressure level, reflection, etc. Methods (5) sometimes brings out howling. The application of (6) is limited. Therefore, it is difficult to construct a sound system free from howling.

SUMMARY OF THE INVENTION

The object of the present invention is to provide a howling protective apparatus having a phase fluctuation circuit in a transmission channel comprising a microphone, an amplifier and a speaker, which comprises a phase fluctuation control means for controlling the operation of the phase fluctuation circuit, a wave peak comparison means for detecting a signal of which the maximum absolute values of adjacent two positive and negative peaks of an input signal becomes substantially equal and a timer circuit for receiving an output from said wave peak comparison means and outputting a signal having a predetermined time width, wherein said phase fluctuation circuit is controlled by an output from said timer circuit.

Another object of the present invention is to provide a howling protective apparatus comprising a gain control means for controlling the degree of amplification of a variable gain amplifier connected in a sound signal line of a speaker device according to an output from an integral circuit, a wave peak comparison means for generating an output signal when the maximum absolute values of adjacent two positive and negative peaks of an input signal are substantially equal and a changing means for varying a coefficient of integration for said integral circuit according to the degree of signals outputted repeatedly and continuously from said wave peak comparison circuit at every cycle of wave peak comparison detection.

Another object of the present invention is to provide a howling protective apparatus for protecting a howling which occurs in a sound collecting and replaying system comprising a microphone, an amplifier and a speaker, which comprises a phase fluctuation circuit connected between the microphone and the speaker, a variable gain circuit and a wave peak comparison circuit for detecting a signal of which the maximum absolute values of adjacent two positive and negative peaks of an input signal become substantially equal, wherein said phase fluctuation circuit and the variable gain circuit are controlled by an output from said wave peak comparison circuit.

DETAILED DESCRIPTION OF THE PREFERRED EMBODIMENTS

In the first embodiment of the present invention, the phase of a sound wave outputted from a speaker is intermittently shifted when maximum absolute values of adjacent two positive and negative peaks of an input signal from a microphone becomes substantially equal, thereby preventing the buildup of howling energy since sound signals of a particular frequency interfere with each other while resonating continuously.

Figure 1:
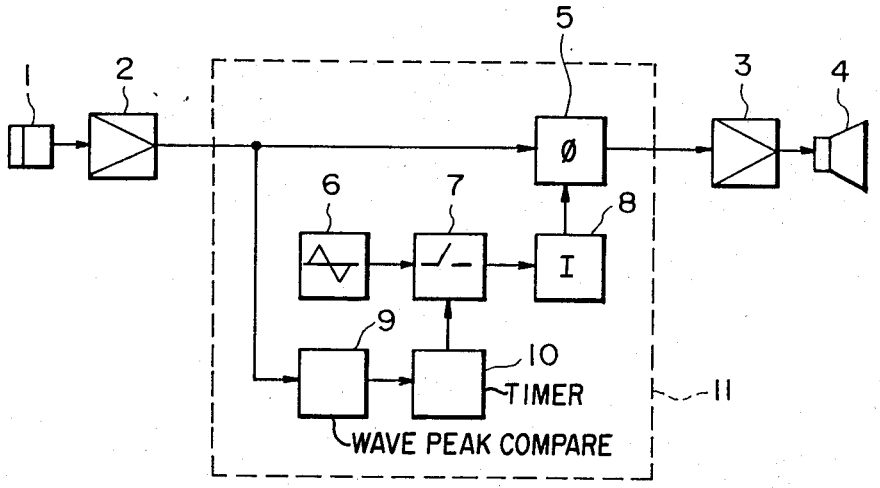
FIG. 1 is a block diagram for a howling protective apparatus provided with a phase fluctuation control circuit according to the present invention.
Figure 2:
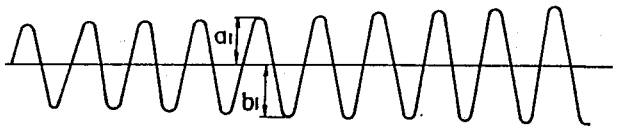
FIGS. 2A and 2B are views of the maximum wave peak comparison in the apparatus of FIG. 1.
Figure 2:
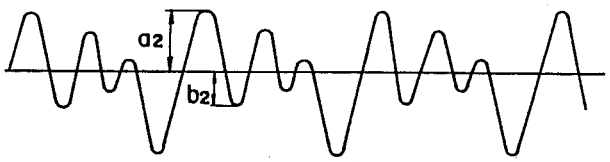

Referring to FIG. 1 to FIG. 3 showing the first embodiment of the invention, a microphone 1, a preamplifier 2, a power amplifier 3 and a speaker 4 constitute a speaker device. A phase fluctuation circuit 5 is connected between the preamplifier 2 and the power amplifier 3. Numeral 6 represents a triangular wave oscillation circuit, 7 a switch circuit connected to the triangular oscillation circuit 6, 8 a control current generation circuit which is connected to the triangular wave oscillation circuit 6 via the switch circuit 7 and generates a fluctuation current and 9 a wave peak comparison circuit connected to the preamplifier 2. A timer circuit 10 is connected to the wave peak comparison circuit 9 and controls ON/OFF of the switch circuit 7 according to an output from the wave peak comparison circuit 9.

A portion 11 enclosed in a chain line, containing said circuits 5–10, is a phase fluctuation control circuit according to the present invention.

A sound signal, entered in the microphone 1, is converted to an electric signal and outputted from the speaker 4 via preamplifier 2, phase fluctuation circuit 5 and the electric power amplifier 3. The sound wave, outputted from the speaker 4, again enters the microphone 1 while constituting a sound feedback loop.

Now, a process of creating howling is analyzed in more detail as follows. The frequency spectrum of sound waves outputted from the speaker 4 after being amplified in the amplifier is further amplified in a particular frequency due to reflections and interference, etc. In the space, while entering again in the microphone 1 with a microscopic time delay, peculiar to the related sound feedback loop, and again outputted from the speaker 4. Sound waves outputted first from the speaker 4 are defined as a primary output while defining a secondly output by sound waves outputted again from the speaker 4.

Thus, when the secondly output becomes larger than the primary one, namely when the loop gain becomes 1 or more, the signal component of the frequency enhances until a medium among loop components reaches a saturation point, thus creating howling.

Then, the operation of the phase fluctuation control circuit 11 is described in the following.

The triangular wave oscillation circuit 6 is assumed to generate triangular wave output in a period of 1 Hz, for example. This triangular wave output is applied to the control current generation circuit 8 via the switch circuit 7. The control current generation circuit 8 converts the output voltage of the triangular wave oscillation circuit 6 and controls phase fluctuation function of the phase fluctuation circuit 5. Therefore, shifting of the phase for sound signals given by the phase fluctuation circuit 5 is synchronized with the period of oscillation in the triangular wave oscillation circuit 6.

Phase fluctuation in the phase fluctuation circuit 5 is assumed, for example, at a period of 1 Hz and a maximum phase shift angle of 180°. A frequency shift applied to sound signals outputted from the preamplifier 2, when passing through the phase fluctuation circuit 5, becomes 1000.5 Hz for the output with an input signal of 1000 Hz and 100.5 Hz with an input of 100 Hz. Consequently, the effect of phase fluctuation given to sound signals is negligible. Phase fluctuations are applied sequentially as described above, while changing phases of a primary, secondary, . . . , n-th order outputs time after time. Therefore, it becomes difficult that sound waves of a particular wavelength resonate with each other while building up energy gradually.

The function of the wave peak comparison circuit 9 is described next in the following. The wave peak comparison circuit 9 outputs a high-level signal when the maximum absolute values of adjacent two positive and negative peaks of a signal outputted from the preamplifier 2 are substantially equal. The waveforms of howling, in a growing stage from the initial period to immediately before entering saturation state, are sine waves close to simple tone. A rise time for howling, determined by the product of time and loop gain with variables of relative position between microphone 1 and the speaker 4, etc., is required from the creation of initial electric signals which become a major portion of howling to saturation state. This rise time is satisfactorily large compared to the period of 1 wave length for howling frequency. Referring to FIG. 2A, it is revealed that absolute values of two wave peaks $a_1$ for positive side and $b_1$ for negative side which are adjacent in a resonance frequency, a major portion of howling. On the other hand, in sound signals, it often occurs that, as shown in FIG. 2B as $a_2$ and $b_2$, maximum absolute peak values of two freely preferred adjacent positive and negative peaks are not equal.

Figure 3A:
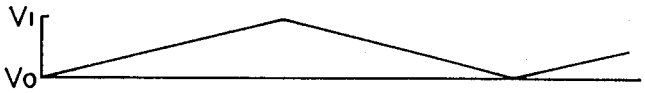
FIGS. 3A–3C show a phase fluctuation operation view in the apparatus of FIG. 1.
Figure 3B:
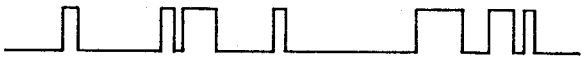
Figure 3C:
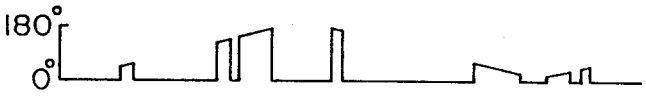

A timer circuit 10 transmits a high-level signal of a predetermined duration to the switch circuit 7 to turn on the latter every time the wave peak comparison circuit 9 changes from low level to high level. Referring to FIG. 3A, it is assumed that the output voltage of the triangular wave oscillation circuit 6 is changing periodically in $V_0$–$V_1$. Then, the phase fluctuation circuit 5 can give phase fluctuations to passing sound signals in phase shift angles of 0°–180° in synchronization with outputs from the triangular wave oscillation circuit 6. However, since the timing of turning ON the switch circuit 7 is the same as the wave peak comparison circuit 9 detects a resonance frequency which generates howling (FIG. 3B). Therefore, it is not always true that the shift angles of the phase fluctuation circuit 5 always start from 0°, but starts from random shift angles (FIG. 3C). Thus, the effect of suppressing resonance becomes quick and certain.

According to the above embodiment, the absolute values of adjacent two positive and negative wave peaks of a sound signal are compared. Only when a signal containing a factor which might grow to howling among sound signals is recognized, gentle phase fluctuation is given at the same time to a wide frequency range. Therefore, the oscillation of a particular frequency can be suppressed quickly and certainly. In addition, deterioration of sound qualities, caused by phase fluctuations applied to sound signals, is kept to a minimum.

It will very scarcely occur that transmission frequency characteristics of a usual sound system are always ideally flat over the entire frequency band. Instead, the characteristics receive the effect of reflections and interference peculiar to the sound field. Therefore, the maximum sound volume which the speaker can output is greatly restricted by the maximum peak value of transmission frequency characteristics. However, according to the present invention, the maximum sound volume which can be output in a sound field without creating howling can be greatly increased.

The present invention further provides such a howling protective apparatus that, even when the degree of amplification for a speaker device is operated at a maximum degree, i.e. in a feedback loop gain close to 1 for the sound system, howling will not occur by the effect of a novel loop gain control circuit even if the microphone or nearby devices are slightly shifted in positions or directions. This loop gain control circuit functions as follows. Absolute maximum values of adjacent two positive or negative wave peaks of an input signal are detected in each wave peak comparison detection cycle. If substantially equal absolute values are detected repeatedly and continuously, the coefficient of integral in the integral circuit is increased or decreased according to the degree of continuation of such detected outputs, thereby the integral quantity of the integral circuit per unit time is also increased or decreased. Thus, the degree of amplification for a variable gain amplifier, connected in the sound signal line, is controlled so that the loop gain in the sound system does not exceed 1.

The second embodiment is detailed referring to FIGS. 4 to 7, in which the same numerals are used to represent common parts in FIGS. 1 to 3.

Figure 4:
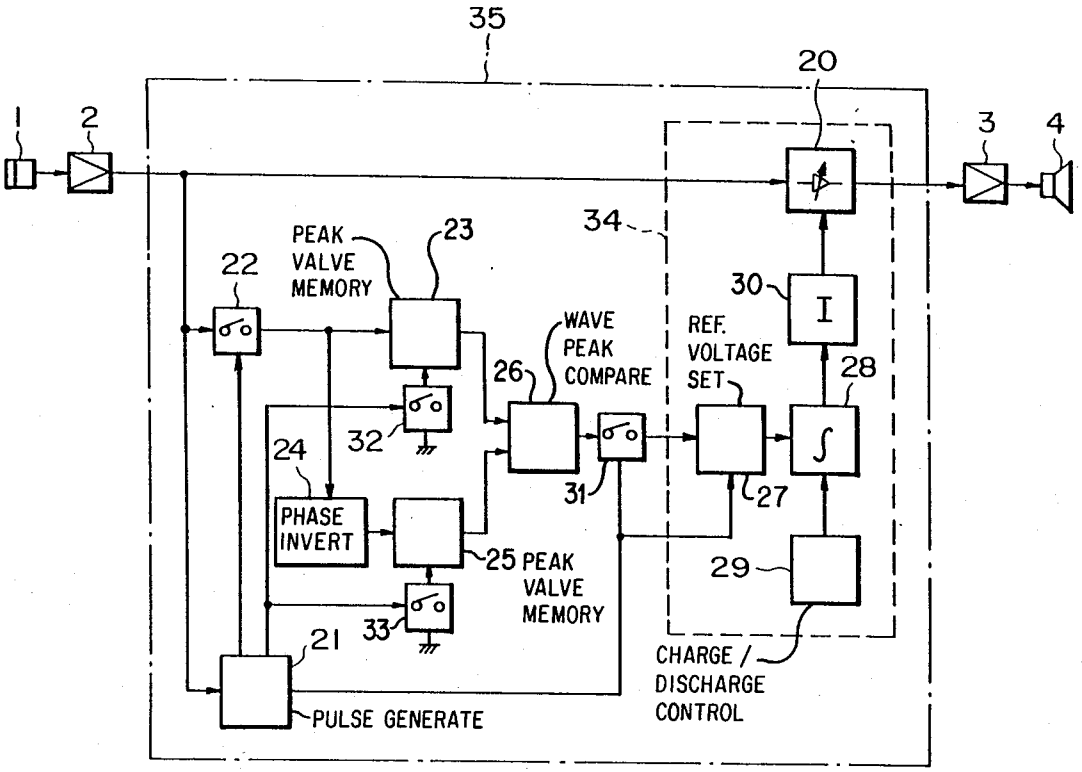
FIG. 4 shows a block diagram of a howling protective apparatus provided with the loop gain control circuit according to the present invention.

Referring to FIG. 4, a speaker device comprises a microphone 1, a preamplifier 2, a power amplifier 3 and a speaker 4. Numeral 20 represents a variable gain amplifier circuit which is connected between the preamplifier 2 and the power amplifier 3. A pulse signal generation circuit 21 receives an input outputted by the preamplifier 2 and converts the input signal to pulse signal. A first switch circuit 22 controls to interrupt the output of the preamplifier 2. A first maximum wave peak memory circuit 23 stores a maximum wave peak value of a positive peak of an input signal, via the first switch circuit 22. A phase inversion circuit 24 inverts the phase of an input signal. A second maximum wave peak memory circuit 25 stores a maximum wave peak value of a negative peak of an input signal, via the phase inversion circuit 24 and the first switch circuit 22. A wave peak comparison circuit 26 compares the outputs of the first and second maximum wave peak memory circuits 23, 25. A reference voltage setting circuit 27 sets up a reference voltage corresponding to the output signal of the wave peak comparison circuit 26. An integral circuit 28 accumulates a voltage supplied from the reference voltage setting circuit 27. A charge/discharge control circuit 29 controls charging/discharging of the integral circuit 28. A control current generation circuit 30 converts the output voltage of the integral circuit 28 to a current and controls the degree of amplification in the variable gain amplifier circuit 20. A second switch circuit 31 controls to interrupt the output of the wave peak comparison circuit 26 according to the output from the pulse signal generation circuit 21. A third and a fourth switch circuits 32, 33 reset storing of the first and second maximum wave peak memory circuits 23, 25 according to the outputs from the pulse signal generation circuit 21. A portion, enclosed with a chain line and containing said variable gain amplifier circuit 20, reference voltage setting circuit 27, integral circuit 28, charge/discharge control circuit 29 and said control current generation circuit 30, constitutes an automatic gain control circuit 34. Another portion, enclosed with a 1-dot chain line and containing said circuits 20 to 33, is an embodiment of a circuit 35 according to the loop gain control circuit of the howling protective apparatus based on Invention 2. The operation of the circuit 35 is described in the following.

A sound signal, entered in the microphone 1, is converted to an electric signal and outputted from the speaker 4 via the preamplifier 2, variable gain amplifier circuit 20 and the power amplifier 3, while constituting a sound feedback loop.

Figure 5A:
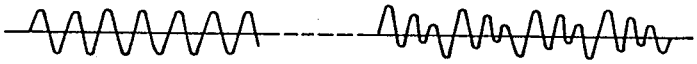
FIGS. 5A–5F are waveform views for describing the operation of each part in FIG. 4.
Figure 5B:
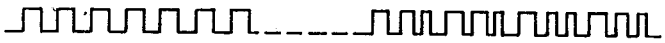
Figure 5C:
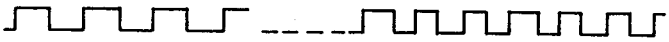
Figure 5D:
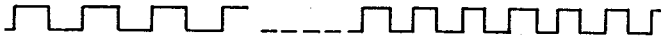
Figure 5E:
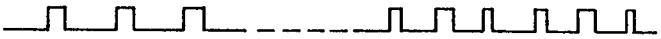
Figure 5F:
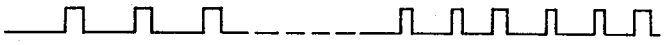

First, the operation of the pulse signal generation circuit 21 and the first, second, third and fourth switch circuits 22, 31, 32 and 33 is described. Referring to FIG. 5, the horizontal line in A shows time which also governs curbs B to F. The pulse signal generation circuit 21 comprises a first pulse generator (FIG. 5B) and a second pulse generator (FIG. 5C). The former generates pulse signals of a duty ratio 50% when a sine input signal enters (FIG. 5A) and the latter generates output pulses in ½ frequency of the pulse frequency of the first pulse generator. The first pulse generator is synchronized with input signals while also the second pulse generator synchronized with input signals provided that two cycles of the input signals becomes one cycle of the pulse generator. The first switch circuit 22 conducts when the second pulse generator is high (FIG. 5D). The second switch circuit 31 conducts when the first pulse generator is high while the second pulse generator being low (FIG. 5E). The third and fourth switch circuits 32, 33 conduct simultaneously when the first and second pulse generators are both low (FIG. 5F). Operation timing of the first, second, third and the fourth switch circuits 22, 31, 32 and 33 is as shown in FIG. 5D, 5E and 5F, in which the switches are sequentially operated in synchronization with input signals in such a frequency as two cycles of the input signals are multiplexed to a cycle.

The first switch circuit 22 conducts at every other cycle of the input signal as shown in FIG. 5D. The maximum value of positive wave peak of the sound signal, outputted from the preamplifier 2 in the meantime, is stored in the first maximum wave peak memory circuit 23. The maximum value of the negative peak, adjacent to said positive peak, is stored in the second maximum wave peak memory circuit 25 after the polarity is changed positive by the phase inversion circuit 24. Values stored in the first and second maximum wave peak memory circuits 23, 25 are compared in the wave peak value comparison circuit 26. The output of the wave peak comparison circuit 26 becomes high when the outputs of the first and second maximum wave peak memory circuits 23, 25 are substantially equal.

Figure 6:
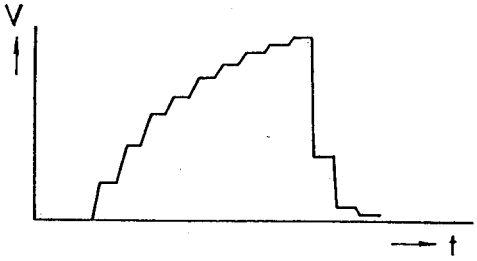
FIG. 6 is a view of waveform outputted from the reference voltage setting circuit in the apparatus of FIG. 4.
Figure 7A:
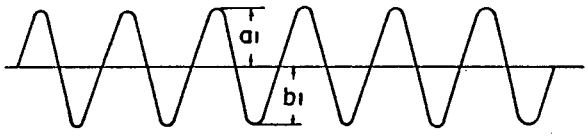
FIGS. 7A (1), (2), (3) and (4) is a comparison view for maximum wave peaks at resonance frequencies of howling.
Figure 7B:
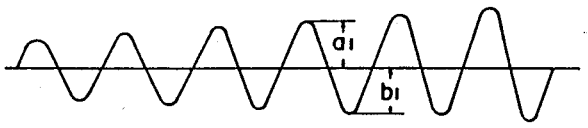
FIGS. 7B–7E form a comparison view of the maximum wave peak of a sound signal.
Figure 7C:
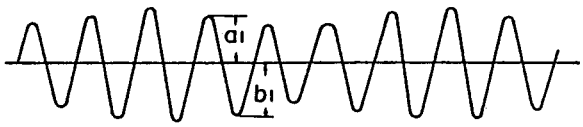
Figure 7D:
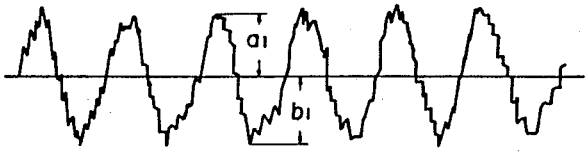
Figure 7E:
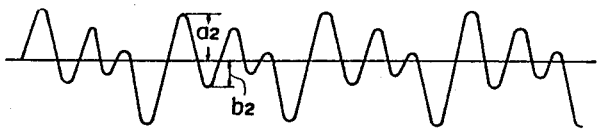

The second switch circuit 31 conducts upon FIG. 5E according to the outputs of the pulse signal generation circuit 21. The voltage of the reference voltage setting circuit 27 gradually increases in a rather large time constant provided that the output of the wave peak comparison circuit 26 becomes high during a period that the second switch circuit 31 conducts. On the contrary, when the output of the wave peak comparison circuit 26 becomes low, the voltage of the reference voltage setting circuit 27 decreases sharply in a small time constant. Accordingly, when high outputs generated repeatedly and continuously from the wave peak comparison circuit 26 are detected, the output voltage of the reference voltage setting circuit 27 builds up by accumulation according to the degree of continuing the detected outputs. When high outputs are interrupted, the output voltage, heretofore increased now suddenly decreases in a decrement gradient steeper than the degree of increasing. The output waveform of the reference voltage setting circuit 27 is shown in FIG. 6.

The third and fourth switch circuits 32, 33 conduct upon FIG. 5F according to the output of the pulse signal generation circuit 21, while resetting stored values in the first and second maximum wave peak memory circuits 23, 25.

FIG. 7 shows a maximum wave peak comparison view. The howling waveform is a sine wave close to simple tone from the initial period of its occurrence to immediately before a saturation point, while continuing resonance state. Meanwhile, referring to FIG. 7A, the absolute value of a maximum positive peak $a_1$ is substantially equal to the absolute value of its adjacent negative peak $b_1$, in any part of the resonance chart in howling. On the other hand, in the case of a sound signal, the absolute values of adjacent two positive and negative maximum peaks, as freely selected, are mostly unequal as shown by $a_2$ and $b_2$ of FIG. 7B.

An automatic gain control circuit 34 comprises the reference voltage generation circuit 27, integral circuit 28, charge/discharge control circuit 29, control current generation circuit 30 and the variable gain amplifier circuit 20 which are devised in such a manner that, when sound signal entered via the microphone 1 and the preamplifier 2 is controlled by the variable gain amplifier circuit 20 and then outputted through the power amplifier 3 and the speaker 4, the audience will not realized any foreign feeling.

A speaker device, in which the amplification degree of the speaker is set up rather high and the speaker is used with a feedback loop gain close to 1 in the sound system namely at a critical howling point, is so unstable as howling occurs immediately even by slight change of environmental conditions. Possible reasons for this might include that the transmission frequency characteristics of the sound system are not normally flat in a wide range, that reflections, diffractions and interference occur in sound waves transmitted in the air, that the level and phase, etc. of transmission frequencies continually fluctuate according to voltage-phase characteristics, etc. when sound signals pass the electric system and that the gain of the feedback loop also changes every moment according to frequencies.

According to the second embodiment as above, the output voltage of the reference voltage setting circuit 27 is increased or decreased, when the maximum absolute values of adjacent two positive and negative peaks of an input signal are repeatedly and continuously outputted every wave peak comparison detection cycles with substantially equal values, according to the degree of continuing the detection outputs. Thus, the variable gain amplifier circuit 20 is controlled. Consequently, the occurrence of howling is effectively suppressed regardless of high or low level of a sound which passes the sound signal line or without depressing the level of the sound in excess.

The howling preventing effect is much more enhanced by combining the phase fluctuation control circuit of the first embodiment with the variable gain amplifier of the second embodiment in which the system is operated at a feedback loop gain of no more than 1.

Figure 8:
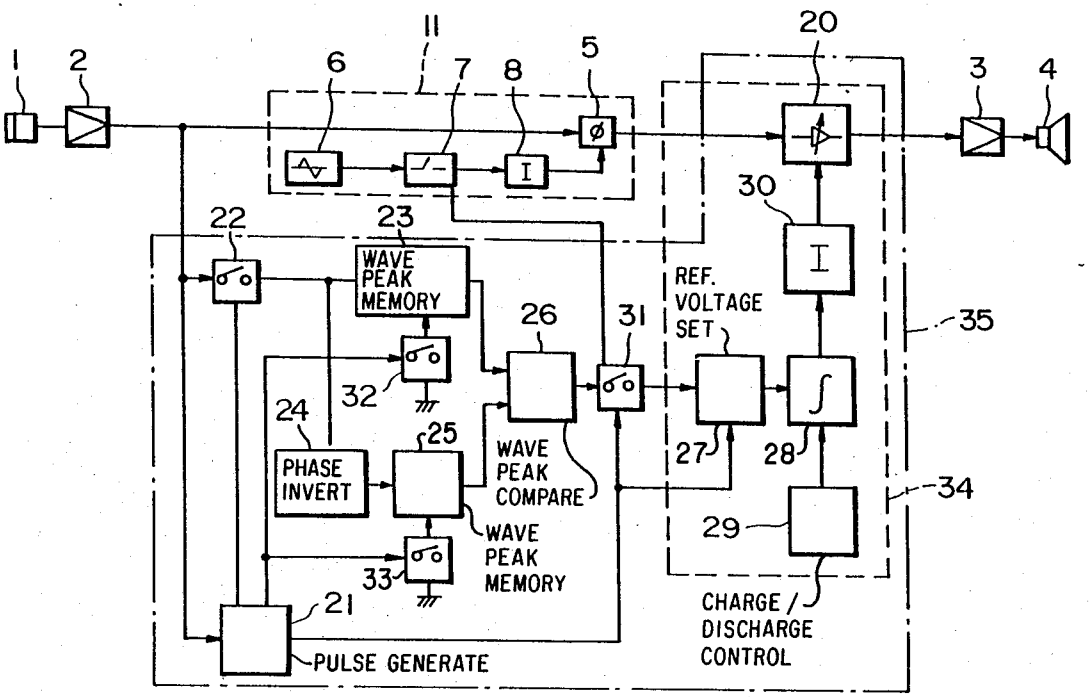
FIG. 8 is a block diagram for a howling protective apparatus in combination of the apparatuses of FIG. 1 and FIG. 4.

The third embodiment of the present invention provides such apparatus as shown in FIG. 8. In FIG. 8, a speaker device comprises a microphone 1, a preamplifier 2, a power amplifier 3 and speaker 4. Numeral 11 represents an example of the controlling phase fluctuation circuit according to the first embodiment. Numeral 35 corresponds to the loop gain control circuit of the second embodiment. These circuits 11, 35 are connected between the preamplifier 2 and the power amplifier 3.

With such a provision, the phase of sound waves outputted from the speaker is intermittently shifted when the maximum absolute values of adjacent two positive and negative peaks of an input signal entered in the microphone are substantially equal, thereby preventing a particular frequency from increasing its energy throughout interference by a peculiar position and continuous resonance. In addition, according to another aspect of the present invention, there is an integral circuit which can control the degree of amplification for the variable gain amplifier, when the maximum absolute values of adjacent two positive and negative peaks of said input signal become substantially equal and detected repeatedly and continuously every wave peak comparison detection cycles, according to the level of the absolute values. Thus, the quantity of integral per unit time in the integral circuit is increased or decreased for controlling the degree of amplification in the variable gain amplifier, connected in the sound signal line, so that the loop gain of the sound system does not exceed 1. Thereby, prevention of howling is operated more effectively.

What is claimed is:

1. A howling protective apparatus having a phase fluctuation circuit in a transmission channel comprising a microphone, an amplifier and a speaker, which comprises a phase fluctuation control means for controlling the operation of the phase fluctuation circuit, a wave peak comparison means for detecting a signal of which the maximum absolute values of adjacent two positive and negative peaks of an input signal are substantially equal and a timer circuit for receiving an output from said wave peak comparison means and outputting a signal having a predetermined time width, wherein said phase fluctuation circuit is controlled by an output from said timer circuit.

2. A howling protective apparatus comprising a gain control means for controlling the degree of amplification of a variable gain amplifier connected in a sound signal line of a speaker device according to an output from an integral circuit, a wave peak comparison means for generating an output signal when the maximum absolute values of adjacent two positive and negative peaks of an input signal are substantially equal and a changing means for varying a coefficient of integration for said integral circuit according to signals outputted repeatedly and continuously from said wave peak comparison circuit at every cycle of wave peak comparison detection.

3. A howling protective apparatus for protecting a howling which occurs in a sound collecting and replaying system comprising a microphone, an amplifier and a speaker, which comprises a phase fluctuation circuit connected between the microphone and the speaker, a variable gain circuit and a wave peak comparison circuit for detecting a signal of which the maximum absolute values of adjacent two positive and negative peaks of an input signal become substantially equal, wherein said phase fluctuation circuit and the variable gain circuit are controlled by an output from said wave peak comparison circuit.

* * * * *

UNITED STATES PATENT AND TRADEMARK OFFICE

CERTIFICATE OF CORRECTION

PATENT NO. : 4,905,290

DATED : February 27, 1990

INVENTOR(S) : YAOITA

It is certified that error appears in the above-identified patent and that said Letters Patent is hereby corrected as shown below:

On the cover page, Item [30], "Jul. 12, 1988" should read --December 7, 1988--.

Signed and Sealed this

Sixth Day of August, 1991

*Attest:*

*Attesting Officer*

HARRY F. MANBECK, JR.

*Commissioner of Patents and Trademarks*